US009915512B1

(12) United States Patent
Roach et al.

(10) Patent No.: US 9,915,512 B1
(45) Date of Patent: Mar. 13, 2018

(54) TECHNOLOGIES FOR ANALYZING AND DEACTIVATING AN EXPLOSIVE DEVICE

(71) Applicant: Special Electronics, Inc., Mitchell, IN (US)

(72) Inventors: Michael W. Roach, Mitchell, IN (US); Travis M. Andreas, Springville, IN (US)

(73) Assignee: Special Electronics, Inc., Mitchell, IN (US)

( * ) Notice: Subject to any disclaimer, the term of this patent is extended or adjusted under 35 U.S.C. 154(b) by 323 days.

(21) Appl. No.: 14/939,680

(22) Filed: Nov. 12, 2015

(51) Int. Cl.
*G01L 5/14* (2006.01)
*F42C 99/00* (2006.01)

(52) U.S. Cl.
CPC ..... *F42C 99/00* (2013.01)

(58) Field of Classification Search
None
See application file for complete search history.

(56) References Cited

U.S. PATENT DOCUMENTS 3,356,024 A * 12/1967 Driscoll ..... F42B 3/192 102/202.6
3,589,294 A * 6/1971 Stresau ..... F42C 11/02 102/202.8
4,719,797 A * 1/1988 Weickert ..... F42B 35/00 73/167
5,027,709 A * 7/1991 Slagle ..... F42B 8/28 102/293
6,439,127 B1 * 8/2002 Cherry ..... F42B 12/36 102/402
2007/0209500 A1 * 9/2007 Wilber ..... F42D 5/045 86/50
2009/0188379 A1 * 7/2009 Hiza ..... F42D 5/00 86/50
2013/0202073 A1 * 8/2013 Shaban ..... H05H 3/06 376/114
2016/0209194 A1 * 7/2016 Schill, Jr. ..... F41H 11/136

* cited by examiner

*Primary Examiner* — Andre Allen
(74) *Attorney, Agent, or Firm* — Barnes & Thorburg LLP

(57) ABSTRACT

Technologies for analyzing and deactivating an explosive device include electrically connecting an analysis device to a pair of trigger wires of the explosive device, performing a number of electrical measurements, and determining a deactivation action to be performed on the explosive device based on the electrical measurements (e.g., based on the calculated resistance between the trigger wires). In a disclosed embodiment, a primary lead of the analysis device is electrically coupled to a first trigger wire of the explosive device and a pair of secondary leads are each electrically coupled to a second trigger wire of the explosive device. The analysis device measures a voltage between the primary lead and at least one of the secondary leads. The analysis device also measures a current flowing through the secondary leads after a link of trigger wire extending between the leads has been cut or broken. The analysis device determines the deactivation action by determining a resistance of the analysis device based on the measured voltage and current. The deactivation action may include applying shunt to the trigger wires or cutting one or more trigger wires.

32 Claims, 12 Drawing Sheets

TECHNOLOGIES FOR ANALYZING AND DEACTIVATING AN EXPLOSIVE DEVICE

BACKGROUND

Explosive devices, including improvised explosive devices (IEDs), "homemade bombs," and more conventional bombs, are dangerous explosives used to destroy structures and/or inflict harm on individuals, including military personnel and civilians. Explosive devices may have various components and architecture depending on their corresponding design. Generally, most explosive devices include an explosive charge and a corresponding detonation device or circuit configured to denote the explosive charge upon activation of a trigger switch or other activator mechanism. Depending on the type of explosive device, the trigger switch may be of varying design such as a pressure switch, trip wire, remotely-activated switch, and/or the like.

Bomb disposal personnel and similar individuals are trained to deactivate explosive devices. However, due to the varying complexity of explosive devices and deactivation counter-measures that may be included in some explosive devices (e.g., common wire color, secondary trigger switches, etc.), deactivation or neutralization of an explosive device is an extremely dangerous endeavor. While some equipment exist to help in the neutralization of explosive devices, typical bomb disposal equipment rely on a controlled explosion of the explosive device, which may not be feasible in some circumstances due to collateral damage and other factors.

SUMMARY

According to one aspect, a method for analyzing an explosive device may include measuring, by an analysis device electrically coupled to the explosive device, a voltage between a primary lead of the analysis device and at least one of a pair of secondary leads of the analysis device. The primary lead may be electrically connected to a first trigger wire of the explosive device and each of the secondary leads may be electrically coupled to a second trigger wire of the explosive device. The method may also include measuring, by the analysis device, a current flowing through the pair of secondary leads electrically coupled to the second trigger wire of the explosive device and determining, by the analysis device, a resistance of a trigger mechanism of the explosive device based on the measured voltage and current. Additionally, the method may include determining, by the analysis device, a deactivation action to be applied to the explosive device based on the determined resistance of the trigger mechanism.

In some embodiments, measuring the voltage between the primary lead and the at least one of the pair of secondary leads may include determining, by the analysis device, whether continuity between a first secondary lead and a second secondary lead of the pair of secondary leads has been established and measuring, by the analysis device, a voltage between the primary lead and the at least one of the first secondary lead and the second secondary lead in response to a determination that continuity between the first secondary lead and the second secondary lead of the pair of secondary leads has been established. Additionally, in such embodiments, measuring the current flowing through the pair of secondary leads may include determining, by the analysis device, whether continuity between the first secondary lead and the second secondary lead has been broken and measuring, by the analysis device, the current flowing through the pair of secondary leads in response to a determination that the continuity between the secondary leads has been broken. Further, in such embodiments, determining whether continuity between the secondary leads has been broken may include determining, by the analysis device, whether a link of the second trigger wire extending between the first secondary lead and the second secondary lead has been broken. In some embodiments, the method may also include instructing, by the analysis device, a user of the analysis device to cut the link of the second trigger wire extending between the first secondary lead and the second secondary lead prior to measuring the current flowing through the pair of secondary leads.

In some embodiments, determining the deactivation action may include determining, by the analysis device, that the first trigger wire and the second trigger should be shunted together. In such embodiments, determining that the first trigger wire and the second trigger should be shunted together may include determining that the first trigger wire and the second trigger should be shunted together in response to the determined resistance being less than a low resistance threshold value. Additionally or alternatively, determining the deactivation action may include determining, by the analysis device, that at least one of the first trigger wire and the second trigger should be cut. In such embodiments, determining that at least one of the first trigger wire and the second trigger should be cut may include determining that at least one of the first trigger wire and the second trigger should be cut in response to the determined resistance being greater than a high resistance threshold value.

In some embodiments, determining the deactivation action may include determining, by the analysis device, that no action should be applied to the explosive device. In such embodiments, determining that no action should be applied to the explosive device may include determining that no action should be applied to the explosive device in response to the determined resistance being between a low resistance threshold value and a high resistance threshold value. In some embodiments, the method may also include displaying, by the analysis device, the measured voltage and the measured current on a display of the analysis device. Additionally or alternatively, the method may include displaying, by the analysis device, the determined resistance of the trigger mechanism on a display of the analysis device. Additionally or alternatively, the method may include notifying, by the analysis device, a user of the analysis device of the deactivation action to be applied to the explosive device. Additionally or alternatively, the method may include determining, by the analysis device, a direction of trigger mechanism relative to at least one of the pair of trigger wires and notifying, by the analysis device, a user of the analysis device of the direction of the trigger mechanism relative to the at least one of the pair of trigger wires.

According to another aspect, an analysis device for analyzing an explosive device may include a primary lead, a pair of secondary leads, an analysis circuit, and a processor circuit. The primary lead may be configured to be electrically coupled to a first trigger wire of the explosive device. The pair of secondary leads may be configured to be electrically coupled to a second trigger wire of the explosive device. The analysis circuit may be configured to (i) measure a voltage between the primary lead and at least one of the pair of secondary leads and (ii) measure a current established through the pair of secondary leads. Additionally, the processor circuit may be configured to (i) determine a resistance of a trigger mechanism of the explosive device based on the measured voltage and current and (ii) a deactivation action to be applied to the explosive device based on the determined resistance of the trigger mechanism.

In some embodiments, the analysis circuit may be further configured to determine whether continuity between a first secondary lead of the pair of secondary leads and a second secondary lead of the pair of secondary leads has been established. In such embodiments, to measure the voltage between the primary lead and the at least one of the pair of secondary leads may include to measure a voltage between the primary lead and the at least one of the first secondary lead and the second secondary lead in response to a determination that continuity between the first secondary lead and the second secondary lead of the pair of secondary leads has been established.

Additionally, in some embodiments, the analysis circuit may be further configured to determine whether continuity between the first secondary lead and the second secondary lead has been broken. In such embodiments, to measure the current established through the pair of secondary leads may include to measure a current established through the pair of secondary leads in response to a determination that the continuity between the secondary leads has been broken. Additionally, in such embodiments, to determine whether continuity between the secondary leads has been broken may include to determine a whether a link of the second trigger wire extending between the first secondary lead and the second secondary lead has been broken. Additionally, in such embodiments, the analysis device may further include an output device and the processor circuit may be further configured to provide an instruction, via the output device, to a user of the analysis device to cut the link of the second trigger wire extending between the first secondary lead and the second secondary lead prior to the analysis circuit performing the measurement of the current established through the pair of secondary leads.

In some embodiments, to determine the deactivation action may include to determine that the first trigger wire and the second trigger should be shunted together. In such embodiments, to determine that the first trigger wire and the second trigger wire should be shunted together may include to determine that the first trigger wire and the second trigger wire should be shunted together in response to the determined resistance being less than a low resistance threshold value. Additionally or alternatively, to determine the deactivation action may include to determine that at least one of the first trigger wire and the second trigger should be cut. In such embodiments, to determine that at least one of the first trigger wire and the second trigger should be cut may include to determine that at least one of the first trigger wire and the second trigger should be cut in response to the determined resistance being greater than a high resistance threshold value. Additionally or alternatively, to determine the deactivation action may include to determine that no action should be applied to the explosive device. In such embodiments, to determine that no action should be applied to the explosive device may include to determine that no action should be applied to the explosive device in response to the determined resistance being between a low resistance threshold value and a high resistance threshold value.

In some embodiments, the analysis device may further include a display. In such embodiments, the processor circuit may be further configured to display the measured voltage and the measured current on the display. Additionally or alternatively, the processor circuit may be further configured to display the determined resistance of the trigger mechanism on the display. In some embodiments, the analysis device may further include at least one output device. In such embodiments, the processor circuit may be further configured to provide a notification, via the at least one output device, to a user of the analysis device of the deactivation action to be applied to the explosive device. Additionally or alternatively, the processor circuit is may be further configured to determine a direction of trigger mechanism relative to at least one of the pair of trigger wires and notify, via at least one output device of the analysis device, a user of the analysis device of the direction of the trigger mechanism relative to the at least one of the pair of trigger wires.

According to yet another aspect, a method for deactivating an explosive device may include connecting a primary lead of an analysis device to a first trigger wire of the explosive device; connecting each of a pair of secondary leads of the analysis device to a second trigger wire of the explosive device; and controlling the analysis device to perform a measurement of a voltage between the primary lead and at least one of a pair of secondary leads. Additionally, the method may include cutting a link of the second trigger wire between the pair of secondary leads; controlling the analysis device to perform a measurement of a current flowing through the pair of secondary leads after cutting the link of the second trigger wire; and performing a deactivation action on the explosive device based on an instruction provided by the analysis device based on the measured voltage and current. In some embodiments, performing the deactivation action may include (i) electrically shunting the first trigger wire and the second trigger wire or (ii) cutting one of the first trigger wire or second trigger wire.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale. Where considered appropriate, reference labels have been repeated among the figures to indicate corresponding or analogous elements.

DETAILED DESCRIPTION OF THE DRAWINGS

Figure 1:
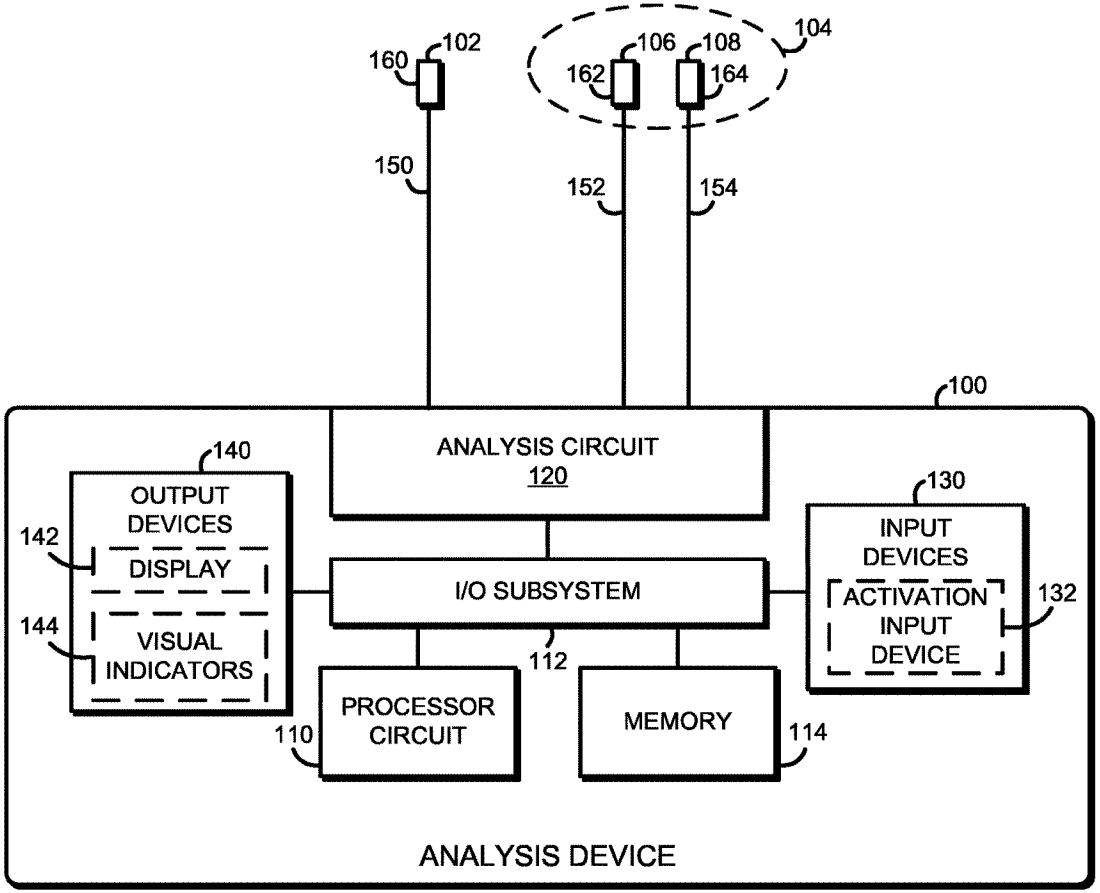
FIG. 1 is a simplified block diagram of at least one embodiment of an analysis device for analyzing and deactivating an explosive device.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

The disclosed embodiments may be implemented, in some cases, in hardware, firmware, software, or any combination thereof. The disclosed embodiments may also be implemented as instructions carried by or stored on a transitory or non-transitory machine-readable (e.g., computer-readable) storage medium, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

As shown in FIG. 1, an analysis device 100 for analyzing and facilitating the deactivation of an explosive device includes a primary lead 102 and a pair of secondary leads 104, which illustrative includes a first secondary lead 106 and a second secondary lead 108. As discussed in more detail below, the analysis device 100 is configured to perform, using the leads 102, 104, various electrical measurements on an explosive device and determine a deactivation action to be applied to the explosive device to deactivate, neutralize, or otherwise render the explosive device incapable of activation via its intended activation mechanism (e.g., via its intended trigger).

Figure 2:
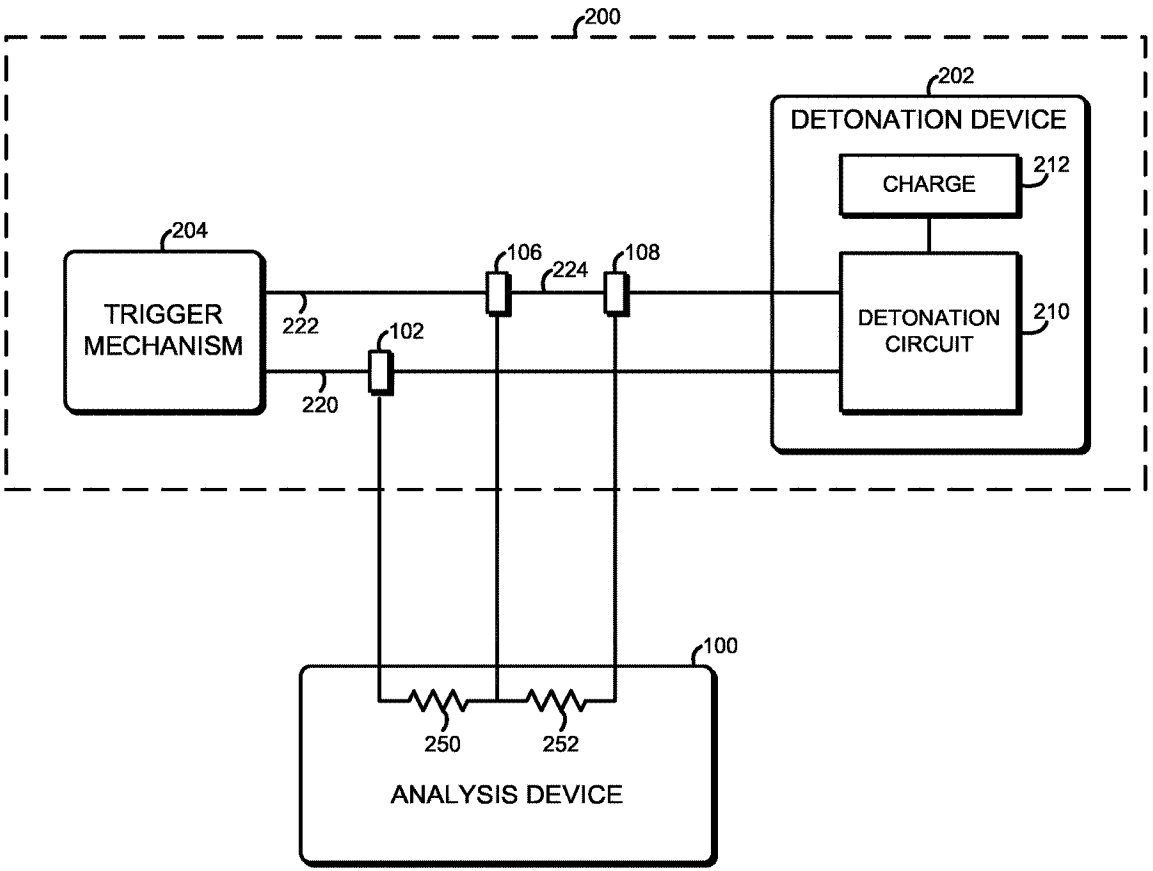
FIG. 2 is a simplified block diagram of the analysis device of FIG. 1 operatively coupled to an explosive device for analysis and deactivation of the explosive device.

In the illustrative embodiment, the analysis device 100 is configured to analyze a two-trigger wire explosive device. One embodiment of a two-trigger-wire explosive device 200 is shown in FIG. 2. The explosive device 200 includes a detonation device 202 and a trigger mechanism 204, which is electrically coupled to the detonation device 202 via a pair of trigger wires 220, 222. The detonation device 202 includes a detonation circuit 210 and an explosive charge 212. The detonation circuit 210 is configured to detonate the explosive charge 212, which may be embodied as any type of explosive material (e.g., a chemical explosive such as a Composition C material, a nuclear explosive, etc.), in response to activation or triggering of the trigger mechanism 204. As such, the detonation circuit 210 may include various electrical components, such as processors, batteries, transformers, integrated circuits, etc., to facilitate the detonation of the explosive charge 212 depending on the particular design or configuration of the explosive device 200.

Similarly, the trigger mechanism 204 of the explosive device 200 may be embodied as any type of trigger device or mechanism capable of triggering the detonation circuit 210 via the pair of trigger wires 220, 222 in response to a trigger event, which may vary depending on the type of trigger mechanism 204. For example, the trigger mechanism 204 may be embodied as a trigger switch, pressure plate, remote controlled switch, trip wire, infrared switch, motion switch, temperature switch, and/or any other suitable trigger device or technology capable of electrical connection to the detonation circuit 210 via the two trigger wires 220, 222. It should be appreciated that the trigger mechanism 204 may be embodied as an opened switch, a closed switch, or a resistive switch that is neither completely opened nor closed. As such, triggering of the trigger mechanism 204 may complete a circuit of the detonation circuit 210 (e.g., send a trigger signal to the detonation circuit 210), break a circuit of the detonation circuit 210 (e.g., remove a trigger signal from the detonation circuit 210), or perform some other type of triggering actuation (e.g., in those embodiments in which the trigger mechanism 204 is a resistive trigger mechanism).

As shown in FIG. 2, in use, the analysis device 100 is electrically connected to each trigger wire of the two-trigger-wire explosive device 200. That is, the primary lead 102 is electrically coupled to a first one of the trigger wires 220, 222 (e.g., to trigger wire 220 as shown in FIG. 2) and each of the secondary leads 104 is electrically coupled to the other one of the trigger wires 220, 222 (e.g., to trigger wire 222 as shown in FIG. 2). The secondary leads 104 are coupled to the corresponding trigger wire 220 such that a link 224 of the trigger wire 220 extends between the two secondary leads 106, 108. Of course, it should be appreciated that electrically connecting a foreign device to the explosive device 200 may accidently cause activation of the explosive device 200 under some circumstances. As such, to reduce the likelihood of adversely interacting with the detonation circuit 210, the analysis device 100 has a very large input impedance 250 (illustratively shown in FIG. 2 as a resistor connected between the primary lead 102 and the secondary leads 104). It should be appreciated that the input impedance 250 is sized such that the connection of the analysis device 100 to the trigger wires 220, 222 results in little to no current draw from the trigger wires 220, 222. For example, in the illustrative embodiment, the input impedance 250 of the analysis device 100 is greater than 100 Megaohms. In one particular embodiment, the input impedance 250 of the analysis device 100 is at least 600 Megaohms. In a similar manner, the analysis device 100 has a very low insertion impedance 252 between the pair of secondary leads 104 (illustratively shown in FIG. 2 as a resistor connected between the first and second secondary leads 106, 108). It should be appreciated that the insertion impedance of the secondary leads 104 is sized such that the insertion of the secondary leads 106, 108 into the trigger wire 222 (i.e., when the link 224 is cut or broken) has little to no impact on any current that may be flowing through the trigger wire 222. For example, in the illustrative embodiment, the insertion impedance 252 of the analysis device 100 is less than 1 ohm. In one particular embodiment, the insertion impedance 252 of the analysis device 100 is no more than 0.15 ohms. In some embodiments, the "insertion impedance" of the analysis device 100 is defined by, indicative of, or otherwise associated with a very low voltage burden, which is defined as the voltage drop across the pair of secondary leads 104 while measuring for extremely low current levels. For example, in an illustrative embodiment, the voltage burden is 60 microvolts or less while measuring current of 600 microamps or less. Such current measurements may be accomplished via a transimpedance amplifier or similar current measurement device or circuit.

After the analysis device 100 is properly electrically connected to the trigger wires 220, 222 of the explosive device 200, a user may control the analysis device 100 to perform a series of electrical measurement of the explosive device 200. In the illustrative embodiment, the analysis device 100 is configured to measure a voltage between the primary lead 102 and at least one of the secondary leads 106, 108. Additionally, after cutting or disconnection of the link 224 (see, e.g., FIG. 12), the analysis device 100 is configured to measure a current flowing through the secondary leads 106, 108. After the electrical measurements are completed, the analysis device 100 determines a resistance of the trigger mechanism 204 based on the measured voltage and current and determines, based on the determined resistance, a deactivation action to be applied to the explosive device 200 by the user to deactivate, neutralize, or otherwise render the explosive device 200 incapable of activation.

Referring back to FIG. 1, the analysis device 100 may be embodied any type of device capable of analyzing a two-trigger-wire explosive device and performing the functions described herein. As such, the analysis device 100 includes various circuits and electronic components and devices to facilitate such analysis functionality. For example, as shown in FIG. 1, the illustrative analysis device 100 includes a processor circuit 110, an input/output ("I/O") subsystem 112, a memory 114, an analysis circuit 120, one or more input devices 130, and one or more output devices 140. Of course, the analysis device 100 may include other or additional components, such as those commonly found in a circuit analysis device in other embodiments. Additionally, in some embodiments, one or more of the illustrative components may be incorporated in, or otherwise form a portion of, another component. For example, the memory 114, or portions thereof, may be incorporated in the processor circuit 110 in some embodiments.

The processor circuit 110 may be embodied as any type of processor or collection of processor device capable of performing the functions described herein. For example, the processor circuit 110 may be embodied as, or otherwise include, a single or multi-core processor(s), a field programmable array (FPGA), a digital signal processor, microcontroller, or other processor or processing/controlling circuit. Similarly, the memory 114 may be embodied as any type of volatile or non-volatile memory or data storage capable of performing the functions described herein. In operation, the memory 114 may store various data and software used during operation of the analysis device 100 such as operating systems, applications, programs, libraries, and drivers. The memory 114 is communicatively coupled to the processor circuit 110 via the I/O subsystem 112, which may be embodied as circuitry and/or components to facilitate input/output operations with the processor circuit 110, the memory 114, the analysis circuit 120, and other components of the analysis device 100. For example, the I/O subsystem 112 may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations.

Figure 4:
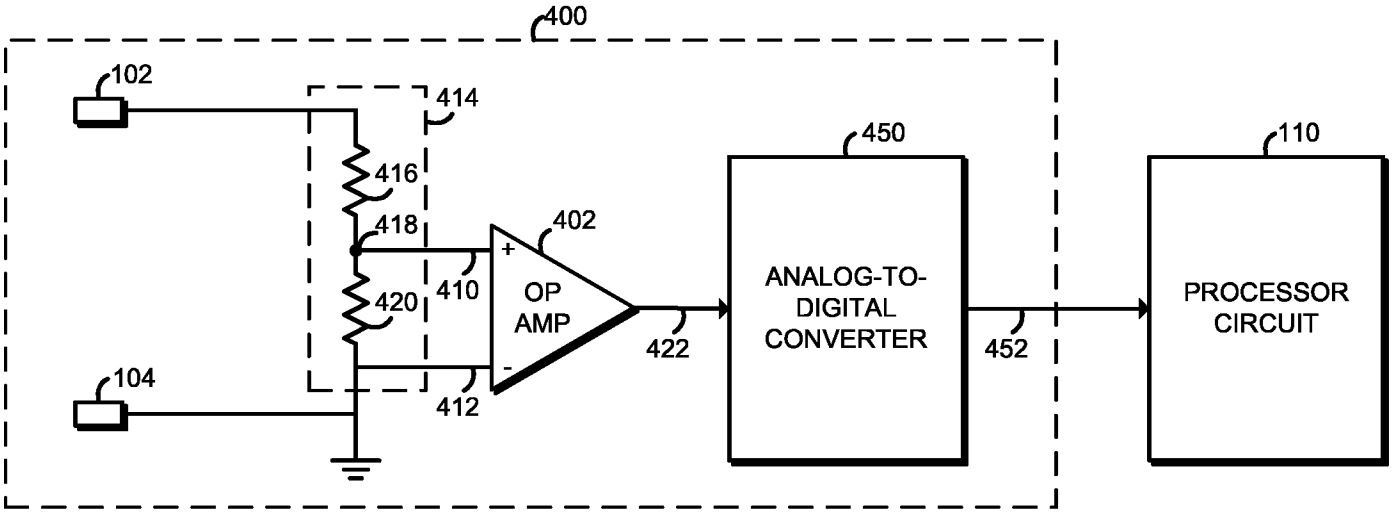
FIG. 4 is a simplified circuit diagram of at least one embodiment of a voltage measurement circuit of the analysis device of FIG. 1.

The analysis circuit 120 may be embodied as a collection of various electrical components (e.g., integrated circuits) and/or sub-circuits configured to perform electrical measurements on the explosive device 200. For example, as discussed in more detail below, the analysis circuit 120 is configured to perform a voltage and current measurement on the explosive device 200 via the leads 102, 106, 108. As such, the analysis circuit 120 may include any electrical component useful in performing and analyzing such measurements. For example, as discussed in more detail below, the analysis circuit 120 may be embodied as, or otherwise include, a voltage measurement circuit 400 and/or a current measurement circuit 500 as shown and described in detail below in regard to FIGS. 4 and 5, respectively.

The input devices 130 may be embodied as, or otherwise include, any type of device capable of facilitating interaction by a user with the analysis device 100. In some embodiments, for example, the input devices 130 may include an activation input device 132, which may be embodied as one or more buttons or switches. Of course, in other embodiments, other types of input devices 130 may be included in the analysis device 100. For example, in some embodiments, the analysis device 100 may include a touch screen interface capable of receiving user selections via tactile input.

The output devices 140 may be embodied as, or otherwise include, any type of device capable of generating an audible, visual, or tactile output to a user of the analysis device 100. For example, in some embodiments, the output devices 140 may include one or more displays 142. The display 142 may be embodied as any type of display capable of displaying images, data, and/or other information to a user including, but not limited to, a liquid crystal display (LCD), a light emitting diode (LED), a plasma display, a cathode ray tube (CRT), or other type of display device. Additionally, the display(s) 142 may be of any size or shape and have any suitable resolution, color, and/or have any other feature or quality commonly found in a display. As discussed above, in some embodiments, the display 142 may include a touchscreen to facilitate user interaction. The touchscreen, if included, may utilize any suitable touchscreen technology to receive tactile input from the user including, but not limited to, resistive, capacitive, and/or acoustic touchscreen technology.

The output devices 140 may additionally or alternatively include other types of devices in other embodiments. For example, in some embodiments, the output devices 140 may include one or more visual indicators 144. Each visual indicator may be embodied as any type of device capable of providing a visual indication to a user including, but not limited to, a light emitting diode (LED) or other illumination device. Additionally, in some embodiments, the analysis device 100 may include one or more audible output devices such as a speaker or buzzer.

In the illustrative embodiment, the primary lead 102 includes a lead wire 150 and a terminal 160. Similarly, each of the secondary leads 106, 108 includes a corresponding lead wire 152, 154 and a corresponding terminal 162, 164, respectively. Each of the lead wires 150, 152, 154 may be any suitable length and formed from any electrically conductive material such as copper or the like. Each of the terminals 160, 162, 164 may be embodied as any type of terminal capable of electrically connecting the corresponding lead wire 150, 152, 154 to one of the trigger wires 220, 222 of the explosive device 200. For example, the terminals 160, 162, 164 may be embodied as an "alligator" clip, probe terminal, and/or other terminal device.

Figure 3:
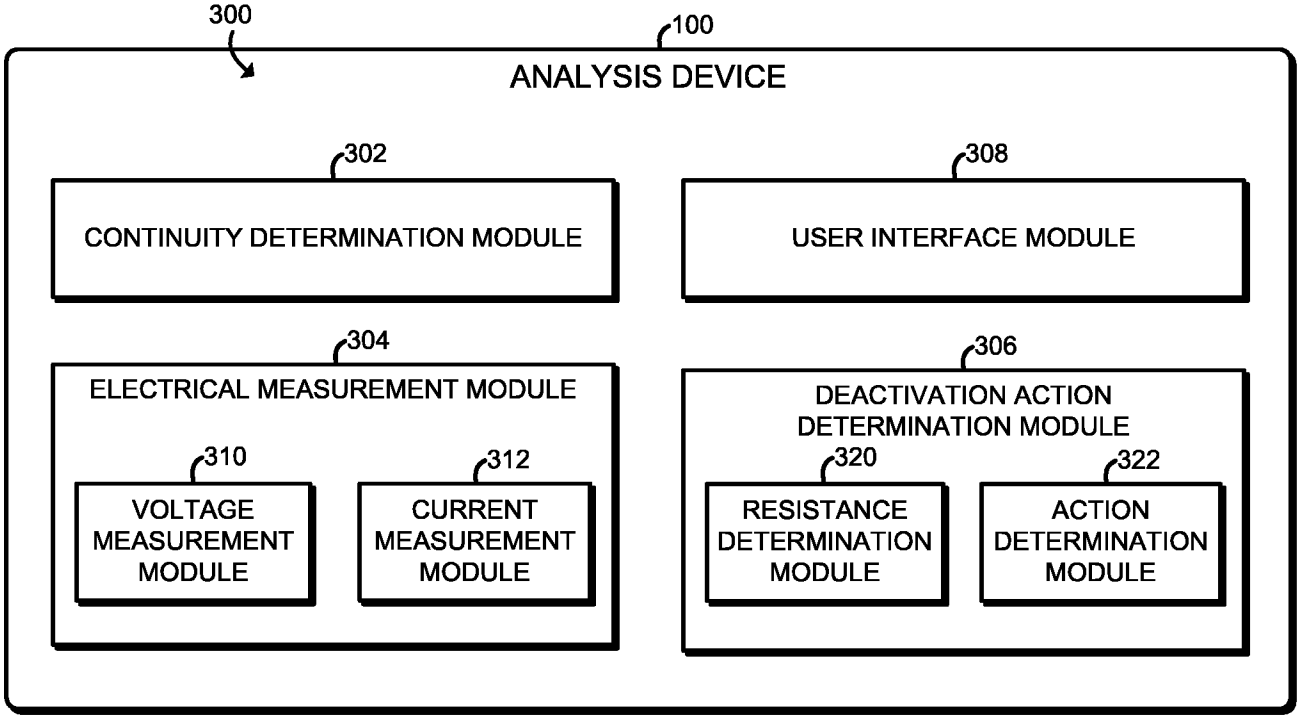
FIG. 3 is a simplified block diagram of at least one embodiment of an environment that may be established by the analysis device of FIG. 1.

Referring now to FIG. 3, in use, the analysis device 100 is configured to establish an environment 300 for analyzing and deactivating an explosive device. The illustrative environment 300 includes a continuity determination module 302, an electrical measurement module 304, a deactivation action determination module 306, and a user interface module 308. The various modules of the environment 300 may be embodied as hardware, software, firmware, or a combination thereof. For example, the various modules, logic, and other components of the environment 300 may form a portion of, or otherwise be established by, the processor circuit 110, the analysis circuit 120, and/or other hardware components of the analysis device 100. As such, in some embodiments, one or more of the modules of the environment 300 may be embodied as circuitry or collection of electrical devices (e.g., the analysis circuit 120, the continuity determination circuit 302, the electrical measurement circuit 304, the deactivation action determination circuit 306, and a user interface circuit 308.) It should be appreciated that, in such embodiments, one or more of the analysis circuit 120, the continuity determination circuit 302, the electrical measurement circuit 304, the deactivation action determination circuit 306, and a user interface circuit 308 may form a portion of one or more of the processor circuit 110, the analysis circuit 120, the I/O subsystem 112, the memory 114, the input devices 130, the output devices 140, and/or other hardware components of the analysis device 100. Additionally, in some embodiments, one or more of the illustrative modules may form a portion of another module and/or one or more of the illustrative modules may be independent of one another.

The continuity determination module 302 is configured to determine or detect continuity between the secondary leads 106, 108. To do so, the continuity determination module 302 may determine or detect continuity between the secondary leads 106, 108 using any suitable methodology, such as measuring an impedance between the secondary leads 106, 108 and determining continuity based on the measured impedance being of a suitably low value. In this way, the continuity determination module 302 is configured detect when the secondary leads 106, 108 have been successfully electrically connected to the trigger wire 222 and, subsequently, when the link 224 of the trigger wire 222 has been successfully cut or broken as discussed in more detail below.

The electrical measurement module 304 is configured to perform electrical measurements of the explosive device 200 after the analysis module has been electrically connected thereto. To do so, the electrical measurement module 304 includes a voltage measurement module 310 and a current measurement module 312. The voltage measurement module 310 is configured to measure a voltage between primary lead 102 and at least one of the secondary leads 106, 108 (i.e., either lead may be used for the voltage measurement due to the very low insertion impedance 252 between the secondary leads 106, 108). In some embodiments, the voltage measurement module 310 may be embodied as, or otherwise include, a voltage measurement circuit, such as the illustrative voltage measurement circuit 400 shown in FIG. 4. The voltage measurement circuit 400 includes an operational amplifier 402 and an analog-to-digital converter 450. The operational amplifier 402 is illustratively embodied as an instrumentation amplifier and has a non-inverting input 410 and an inverting input 412 electrically coupled to a voltage divider 414. The voltage divider 414 includes a first resistor 416 coupled between the primary lead 102 and to a common node 418 to which the non-inverting input 410 of the operational amplifier 402 is electrically coupled. The voltage divider 414 also includes a second resistor 420 electrically coupled between at least one of the secondary leads 104 and the common node 418. The inverting input 412 of the operational amplifier 402 is also electrically coupled to secondary lead 104. The operational amplifier 402 also includes an output 422, which may be embodied as one or more outputs pins, leads, or wires, electrically coupled to the analog-to-digital converter 450. An output 452 of the analog-to-digital converter 450, which may be embodied as a bus of one or more output pins, leads, or wires, electrically coupled to the processor circuit 110 of the analysis device 100. In use, the operational amplifier 410 generates an analog output signal indicative of the voltage difference between the primary lead 102 and the secondary lead(s) 104.

The analog-to-digital converter 450 is illustratively embodied as a multi-channel analog-to-digital converter, but may be embodied as multiple single-channel analog-to-digital converters in other embodiments. The analog-to-digital converter 450 receives analog output signal from the operational amplifier 410 and converts the analog output signal to a digital output signal, which is provided to the processor circuit 110 for processing as discussed in more detail below.

Similar to the voltage measurement module 310, the current measurement module 312 is configured to measure a current flowing through the secondary leads 106, 108 after the link 224 of the corresponding trigger wire 222 has been cut or broken as discussed in more detail below. In some embodiments, the current measurement module 312 may be embodied as, or otherwise include, an current measurement circuit, such as the illustrative current measurement circuit 500 shown in FIG. 5. The current measurement circuit 500 includes a first operational amplifier 502, a second operational amplifier 504, and the analog-to-digital converter 450. As discussed in more detail below, the first operational amplifier 502 is used to measure larger currents flowing through the secondary leads 106, 108, while the second operational amplifier 504 is used to measure smaller currents. The first operational amplifier 502 is illustratively embodied as an instrumentation amplifier and includes a non-inverting input 510 and an inverting input 512 electrically coupled to a resistor 514, which defines a portion of the insertion resistance of the analysis device 100 when the operational amplifier 502 is used to measure the current flowing through the secondary leads 106, 108 as discussed below. The non-inverting input 510 is electrically coupled to the resistor 514 at a common node 516, and the inverting input 512 is electrically coupled to the resistor 514 at a common node 518. The first operational amplifier 502 also includes an output 550, which may be embodied as one or more outputs pins, leads, or wires, electrically coupled to the analog-to-digital converter 450. As discussed above, the analog-to-digital converter 450 is illustrative embodied as a multi-channel analog-to-digital converter capable of receiving multiple inputs, but may be embodied as multiple single-channel analog-to-digital converters in other embodiments.

Figure 5:
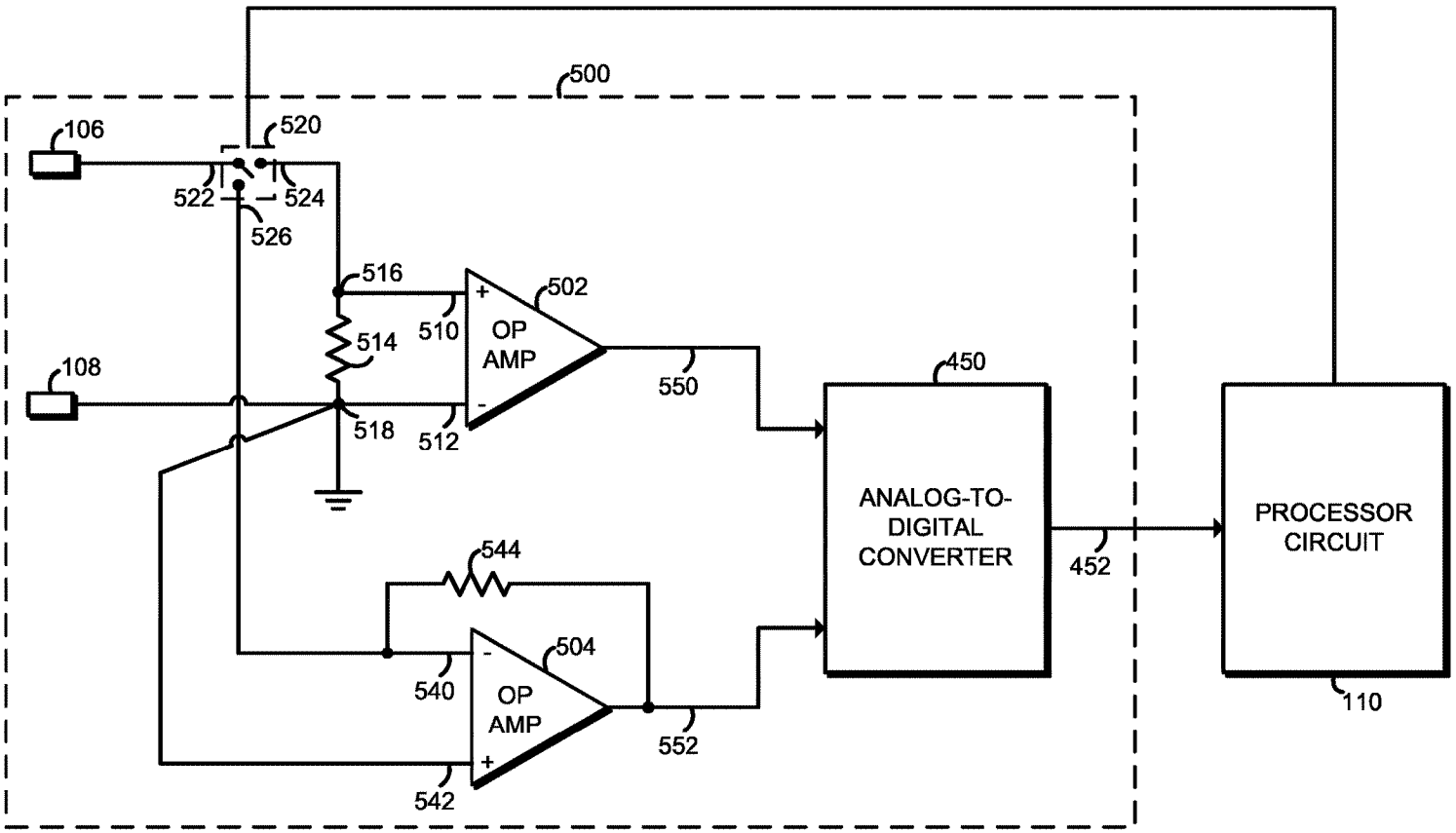
FIG. 5 is a simplified circuit diagram of at least one embodiment of a current measurement circuit of the analysis device of FIG. 1.
Figure 6:
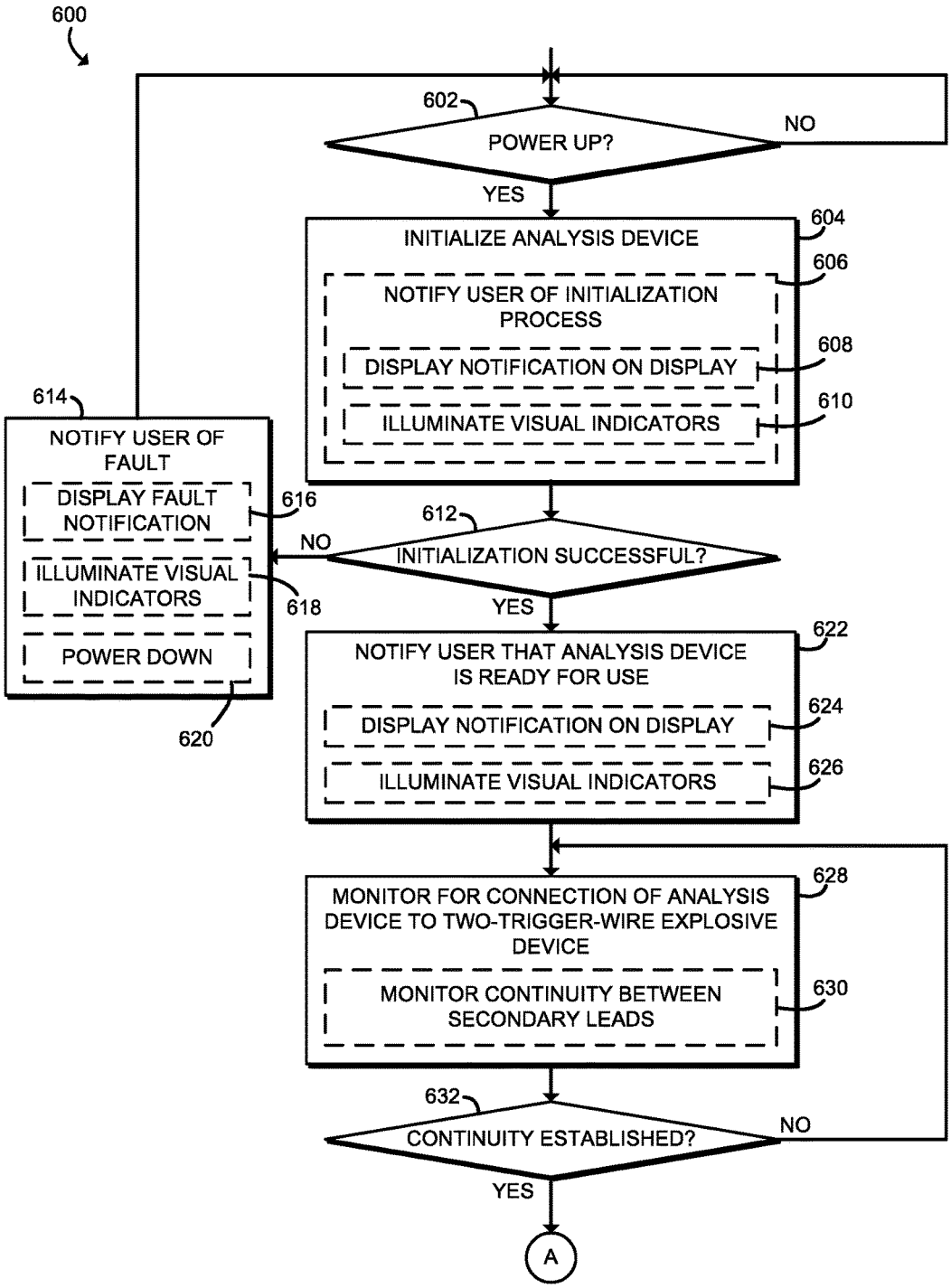
FIGS. 6-9 is a simplified block diagram of at least one embodiment of a method for analyzing an explosive device that may be executed by the analysis device of FIG. 1.
Figure 7:
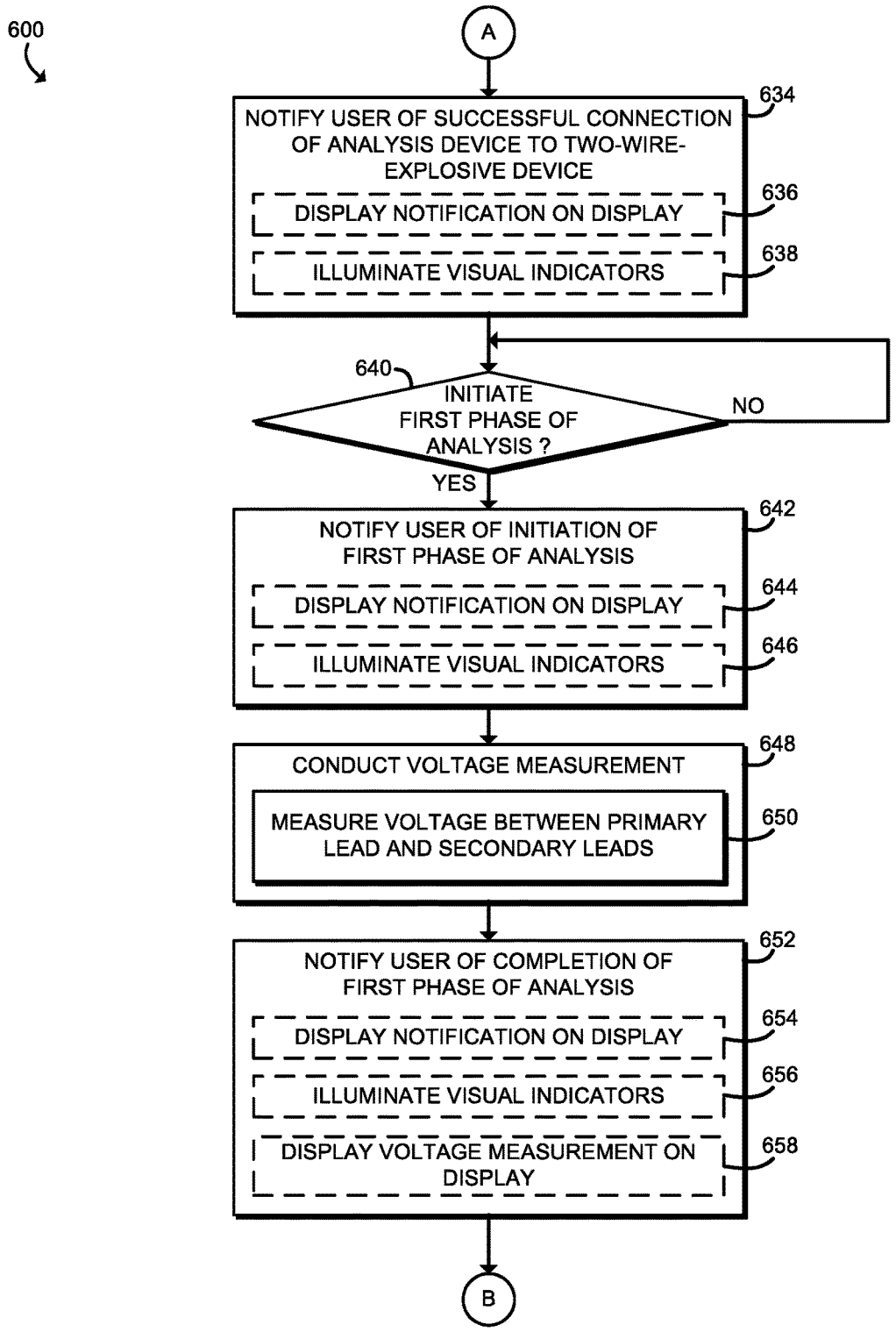

As shown in FIG. 5, the secondary lead 106 of the analysis device 100 is also selectively coupled to the common node 516 via a switch 520. That is, the switch 520 includes an input 522 electrically coupled to the secondary lead 106 and a first output 524 electrically coupled to the common node 516. As discussed in more detail below, the operation of the switch 520 is controlled by the processor circuit 110 to selectively couple the secondary lead 106 to the first operational amplifier 502 or the second operational amplifier 504. As also shown in FIG. 5, the secondary lead 108 is illustratively electrically coupled to the common node 518. However, in other embodiments, the current measurement circuit 500 may include another switch, similar to switch 520, that is configured to selectively couple the secondary lead 108 to the first operational amplifier 502 or the second operational amplifier 504 in a manner similar to the switch 520.

The second operational amplifier 504 is configured as a transimpedance amplifier (i.e., a current-to-voltage converter) and has an inverting input 540 selectively coupled to the secondary lead 106 via the switch 520 and a non-inverting input 542 coupled to the common node 518. Additionally, the second operational amplifier 504 includes a feedback resistor 524 electrically coupled to an output 552 of the second operational amplifier 504 and the inverting input 540. The output 552 of the second operational amplifier 504, which may be embodied as one or more outputs pins, leads, or wires, is also electrically coupled to the analog-to-digital converter 450.

In use, in the illustrative embodiment, the switch 520 initially connects the secondary lead 106 to the first operational amplifier 502. The first operational amplifier 502 generates an analog output signal indicative of the voltage generated across the resistor 514 due to a corresponding current flowing through the secondary leads 106, 108 as discussed above. The analog output signal generated by the first operational amplifier 502 is provided to the analog-to-digital converter 450. The analog-to-digital converter 450 converts the analog output signal to a digital signal (i.e., a digital representation of the current flowing through the secondary leads 106, 108) and provides the digital signal to the processor circuit 110 for processing as discussed in more detail below. If the processor circuit 110 determines that the measured current is too low for proper analysis (e.g., the current magnitude is below a threshold magnitude), the processor circuit 110 controls the switch 520 to disconnect the secondary lead 106 from the first operational amplifier 502 and connect the secondary lead 106 to the second operational amplifier 504. In those embodiments in which the current measurement circuit 500 includes another switch coupled to the secondary lead 108, the processor circuit 110 is configured to control the second switch in a manner similar to the switch 520 to disconnect the secondary lead 108 from the first operational amplifier 502 and connect the secondary lead 108 to the second operational amplifier 504.

The second operational amplifier 504 generates an analog output voltage signal indicative of, or representative of, the current flowing through the secondary leads 106, 108. The analog output signal generated by the second operational amplifier 504 is provided to the analog-to-digital converter 450, which may be embodied as a multi-channel or multiple single channel analog-to-digital converters. As discussed above, The analog-to-digital converter 450 converts the analog output signal to a digital signal (i.e., a digital representation of the current flowing through the secondary leads 106, 108) and provides the digital signal to the processor circuit 110 for processing as discussed in more detail below.

Referring back to FIG. 3, it should be appreciated that the electrical measurement module 304 may be configured to perform the various measurements in response to continuity determinations performed by the continuity determination module 302. For example, in the illustrative embodiment, the voltage measurement module 310 (e.g., the voltage measurement circuit 400) is configured to perform the voltage measurement in response to a determination that continuity has been established between the secondary leads 106, 108, and the current measurement module 312 (e.g., the current measurement circuit 500) is configured to perform the current measurement in response to a determination that the continuity between the secondary leads 106, 108 has been broken as discussed in more detail below.

The deactivation action determination module 306 is configured to analyze the electrical measurements and determine a deactivation action to be performed on the explosive device 200 by the user to deactivate, neutralize, or otherwise render the explosive device 200 inactive. To do so, the deactivation action determination module 306 includes a resistance determination module 320 and an action determination module 322. The resistance determination module 320 is configured to determine a resistance of the trigger mechanism 204 based on the measured voltage and current as determined by the electrical measurement module 304. To do so, the resistance determination module 320 may utilize any suitable methodology to determine the resistance. For example, in the illustrative embodiment, the resistance determination module 320 is configured to determine the resistance by using Ohm's law (i.e., Resistance=Voltage/Current).

The action determination module 322 is configured to determine the particular deactivation action to be applied to the explosive device 200 based on the resistance value determined by the resistance determination module 320. The particular deactivation actions that may be selected may depend on the particular type of explosive devices 200 for which the analysis device 100 is designed to analyze and/or other criteria. In the illustrative embodiment, for example, the action determination module 322 is configured to select or determine a deactivation action from three possible choices. For example, the action determination module 322 is configured to determine that the trigger wires 220, 222 should be closed or shunted together in response to a determination that the resistance value is less than a low resistance threshold value. The low resistance threshold value may be set to any suitably low resistance value that is indicative of a closed switch (e.g., indicative that the trigger mechanism 204 is a closed switch). For example, in the illustrative embodiment, the low resistance threshold value is 10 ohms, but other low resistance values may be used in other embodiments.

Alternatively, the action determination module 322 is configured to determine that the trigger wires 220, 222 should be opened or cut (i.e. at least one of the trigger wires 220, 222 should be cut or opened) in response to a determination that the resistance value is greater than a high resistance threshold value. The high resistance threshold value may be set to any suitably high resistance value that is indicative of an opened switch (e.g., indicative that the trigger mechanism 204 is an opened switch). For example, in the illustrative embodiment, the high resistance threshold value is 10 megaohms, but other high resistance values may be used in other embodiments.

Further, if the determined resistance is neither less than the low resistance threshold value or greater than the high resistance value, the action determination module 322 is configured to determine that no action should be applied to the explosive device 200. That is, under such conditions, the analysis device 100 has determined that the trigger mechanism 204 and/or the detonation circuit 210 is of a complex design and the explosive device 200 cannot be properly deactivated, neutralized, or otherwise rendered inactive using the analysis device 100 alone. In such circumstances, the user may utilize additional devices, mechanisms, and/or methodologies to deactivate the explosive device 200 including, but not limited to, X-rays analysis, remote detonation, and/or other actions.

The user interface module 308 is configured to provide an interface for the user to interact and receive information from the analysis device 100. For example, the user interface module 308 may monitor the input devices 130 to receive input and/or selections from the user. As discussed above, the input devices may include one or more activation input device 132, such as hardware or software buttons, switches, and/or other controls. Additionally, the user interface module 308 may control one or more of the output devices 140 to provide notifications and/or instructions to the user during use of the analysis device 100. For example, in embodiments in which the analysis device 100 includes the display 142, the user interface module 308 may control the display 142 to display various notification and/or instructions to the user as discussed in more detail below. Additionally or alternatively, in embodiments in which the analysis device 100 includes one or more visual indicators 144, the user interface module 308 may control the visual indicators 144 (e.g., by illuminating the visual indicators 144 in a particular pattern, by turning off a visual indicator 144, etc.) to provide various notifications and/or instructions to the user as discussed in more detail below.

Referring now to FIGS. 6-9, in use, the analysis device 100 may execute an illustrative method 600 for analyzing an explosive device. The method 600 begins with block 602 in which analysis device 100 determines whether the device 100 has been recently powered up. If so, the method 600 advances to block 604 in which the analysis device 100 performs various initialization procedures, such as a battery check and/or visual test. Such initialization procedures may include any actions performable by the analysis device 100 to ensure proper operation of the device 100. In some embodiments, in block 606, the analysis device 100 is configured to notify or inform the user that the analysis device 100 is performing such initialization procedures. For example, in block 608, the analysis device 100 may display a notification on the display 142 that the analysis device 100 is performing the initialization procedures. Additionally or alternatively, in block 610, the analysis device 100 may illuminate or operate the visual indicators 144 in a manner to notify the user that the initialization procedures are being conducted (e.g., by flashing one or more LEDs).

After the initialization procedures have been completed, the method 600 advances to block 612 in which the analysis device 100 determines whether the initialization was successful. If not, the method 600 advances to block 614 in which the analysis device 100 notifies the user that the initialization was unsuccessful. For example, the analysis device 100 may display a fault notification on the display 142 in block 616 and/or illuminate the visual indicators 144 in a manner to notify the user that the initialization was unsuccessful in block 618 (e.g., by blinking one or more LEDs). In some embodiments, in block 620, the analysis device 100 may automatically power down. The method 600 subsequently loops back to block 602 in which the analysis device 100 monitors for, or otherwise waits for, power up of the device 100.

Referring back to block 612, if the analysis device 100 determines that the initialization process was successful, the method 600 advances to block 622 in which the analysis device 100 notifies the user that the initialization was successful and the device 100 is ready for use. For example, the analysis device 100 may display a notification on the display 142 in block 624 and/or illuminate the visual indicators 144 in a manner to notify the user that the initialization was successful in block 626 (e.g., by steadily illuminating one or more LEDs).

Subsequently, in block 628, the analysis device 100 monitors for connection of the analysis device 100 to the trigger wires 220, 222 of the explosive device 200. To do so, for example, the analysis device 100 may monitor for establishment of continuity between the secondary leads 106, 108 in block 630. That is, the analysis device 100 may detect when the secondary leads 106, 108 have been successfully electrically connected to the corresponding trigger wire 222 by monitoring for establishment of continuity between the leads 106, 108. As discussed above, the secondary leads 106, 108 are electrically connected to the corresponding trigger wire 222 such that a link 224 of the trigger wire 222 is defined between the secondary leads 106, 108 (see, e.g., FIG. 2).

In block 632, the analysis device 100 determines whether continuity between the secondary leads 106, 108 has been established. If not, the method 600 loops back to block 628 in which the analysis device 100 continues to monitor for continuity between the secondary leads 106, 108. However, if continuity between the secondary leads 106, 108 has been established, the method 600 advances to block 634 of FIG. 7 in which the analysis device 100 notifies the user that the analysis device 100 has been successfully connected to the explosive device 200. For example, the analysis device 100 may display a notification on the display 142 in block 636 and/or illuminate the visual indicators 144 in a manner to notify the user that the device 100 has been successfully connected to the explosive device 200 in block 638 (e.g., by illuminating a "ready" or "status" LED).

After the analysis device 100 determines that successful connection to the explosive device 200 has been established, the method 600 advances to block 640. In block 640, the analysis device 100 determines whether to begin the first phase of the electrical analysis of the explosive device 200. In the illustrative embodiment, the analysis device 100 determines whether to begin the first phase of analysis based on a user selection or input. For example, a user may select an appropriate activation input device 132 (e.g., a hardware or software button) to instruct the analysis device 100 to begin the first phase of analysis. In other embodiments, the analysis device 100 may initiate the first phase of analysis automatically or otherwise without user direction (e.g., in response to determining that the analysis device 100 has been successfully electrically connected to the trigger wires 220, 222 of the explosive device 200).

Regardless, if the analysis device 100 determines to initiate the first phase of analysis, the method 600 advances to block 642 in which the analysis device 100 notifies the user that the analysis device 100 has initiated the first phase of the analysis. For example, the analysis device 100 may display a notification on the display 142 in block 644 and/or illuminate the visual indicators 144 in a manner to notify the user that the first phase of analysis has been initiated in block 646 (e.g., by illuminating or turning off one or more LEDs).

In block 648, the analysis device 100 conducts a voltage measurement on the explosive device 200. To do so, as shown in block 650, the analysis device measures a voltage between the primary lead 102 and at least one of the secondary leads 106, 108. As discussed above, due to the low insertion impedance 252 between the secondary leads 106, 108, either secondary lead 106, 108 may be used in the voltage measurement. After the voltage between the primary lead 102 and the secondary lead 106, 108 has been measured in block 648, the method 600 advances to block 652 in which the analysis device 100 notifies the user that the first phase of analysis has been completed. For example, the analysis device 100 may display a notification on the display 142 in block 654 and/or illuminate the visual indicators 144 in a manner to notify the user that the first phase of analysis has been completed in block 656 (e.g., by illuminating one or more LEDs). Additionally, in some embodiments, the analysis device 100 may display the measured voltage on the display 142 in block 658.

Figure 8:
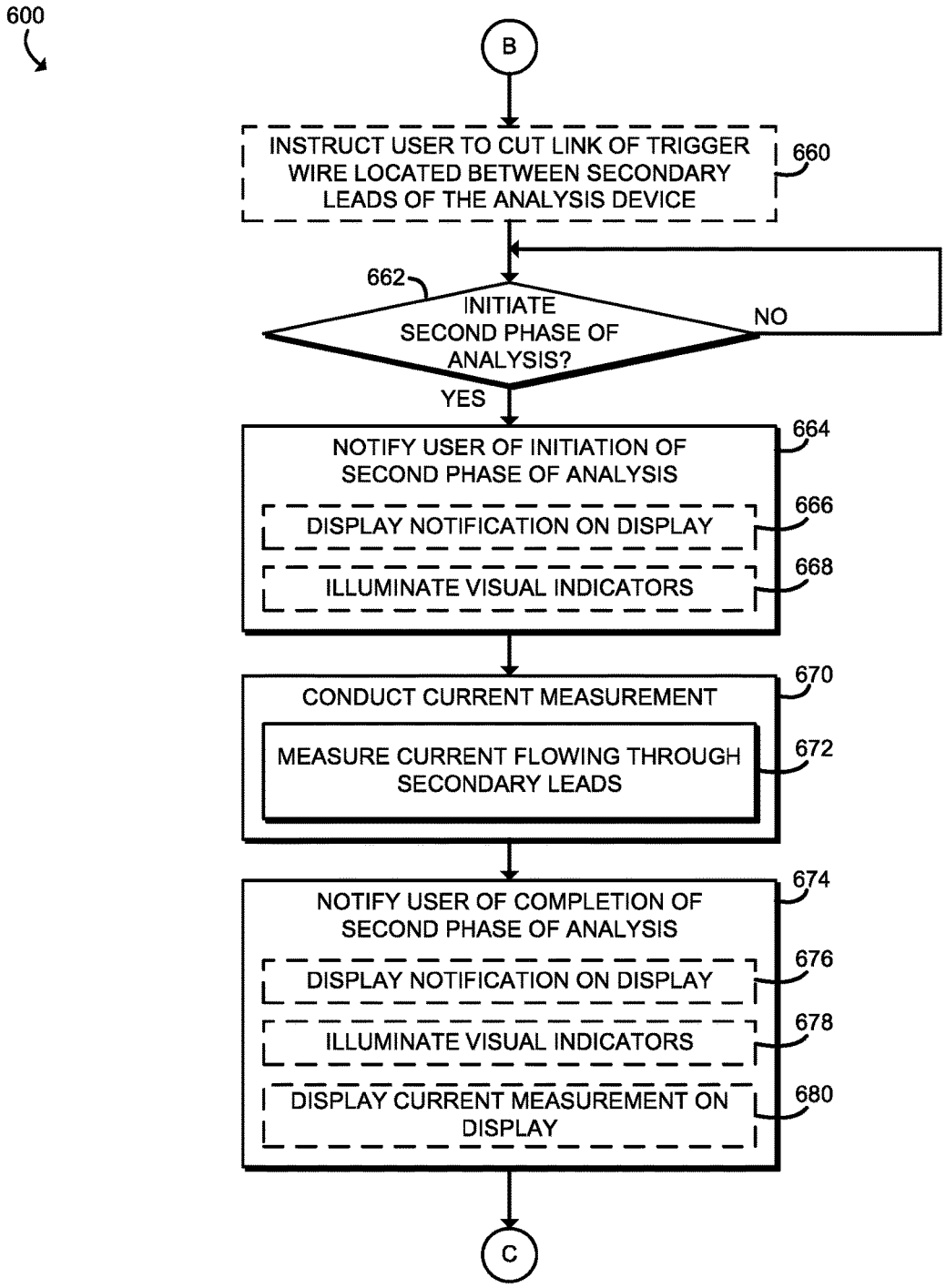

After notifying the user of completion of the first phase of analysis in block 652, the method 600 advances to block 660 of FIG. 8. In block 660, in some embodiments, the analysis device 100 may instruct the user to cut or break the link 224 of the trigger wire 222 located between the secondary leads 106, 108 (see, e.g., FIG. 12). For example, the analysis device 100 may display a suitable instruction message on the display 142 in some embodiments.

In block 662, the analysis device 100 determines whether to begin the second phase of the electrical analysis of the explosive device 200. In the illustrative embodiment, the analysis device 100 determines whether to begin the second phase of analysis based on a user selection or input. For example, a user may select an appropriate activation input device 132 (e.g., a hardware or software button) to instruct the analysis device 100 to begin the second phase of analysis. In other embodiments, the analysis device 100 may initiate the second phase of analysis automatically or otherwise without user direction (e.g., in response to determining that the link 224 of the trigger wire 222 has been successfully cut). In the illustrative embodiment, the analysis device 100 is configured to not begin the second phase of analysis, regardless of user instruction, if the link 224 of the trigger wire 222 has not been cut or otherwise broken. For example, the analysis device 100 may be configured to monitor continuity between the secondary leads 106, 108 and initiate the second phase of analysis only after determining that such continuity has been broken (i.e., the link 224 has been cut or broken).

Regardless, if the analysis device 100 determines to initiate the second phase of analysis, the method 600 advances to block 664 in which the analysis device 100 notifies the user that the analysis device 100 has initiated the second phase of the analysis. For example, the analysis device 100 may display a notification on the display 142 in block 666 and/or illuminate the visual indicators 144 in a manner to notify the user that the second phase of analysis has been initiated in block 668 (e.g., by illuminating or turning off one or more LEDs).

In block 670, the analysis device 100 conducts a current measurement on the explosive device 200. To do so, as shown in block 672, the analysis device 100 is configured to measure a current flowing through the secondary leads 106, 108. It should be appreciated that, because the link 224 of the corresponding trigger wire 222 located between the secondary leads 106, 108 has been cut or broken, any current flowing through the trigger wire 222 flows through the secondary leads 106, 108.

After the current flowing the secondary leads 106, 108 has been measured in block 670, the method 600 advances to block 674 in which the analysis device 100 notifies the user that the second phase of analysis has been completed. For example, the analysis device 100 may display a notification on the display 142 in block 676 and/or illuminate the visual indicators 144 in a manner to notify the user that the second phase of analysis has been completed in block 678 (e.g., by illuminating one or more LEDs). Additionally, in some embodiments, the analysis device 100 may display the measured current on the display 142 in block 680.

Figure 9:
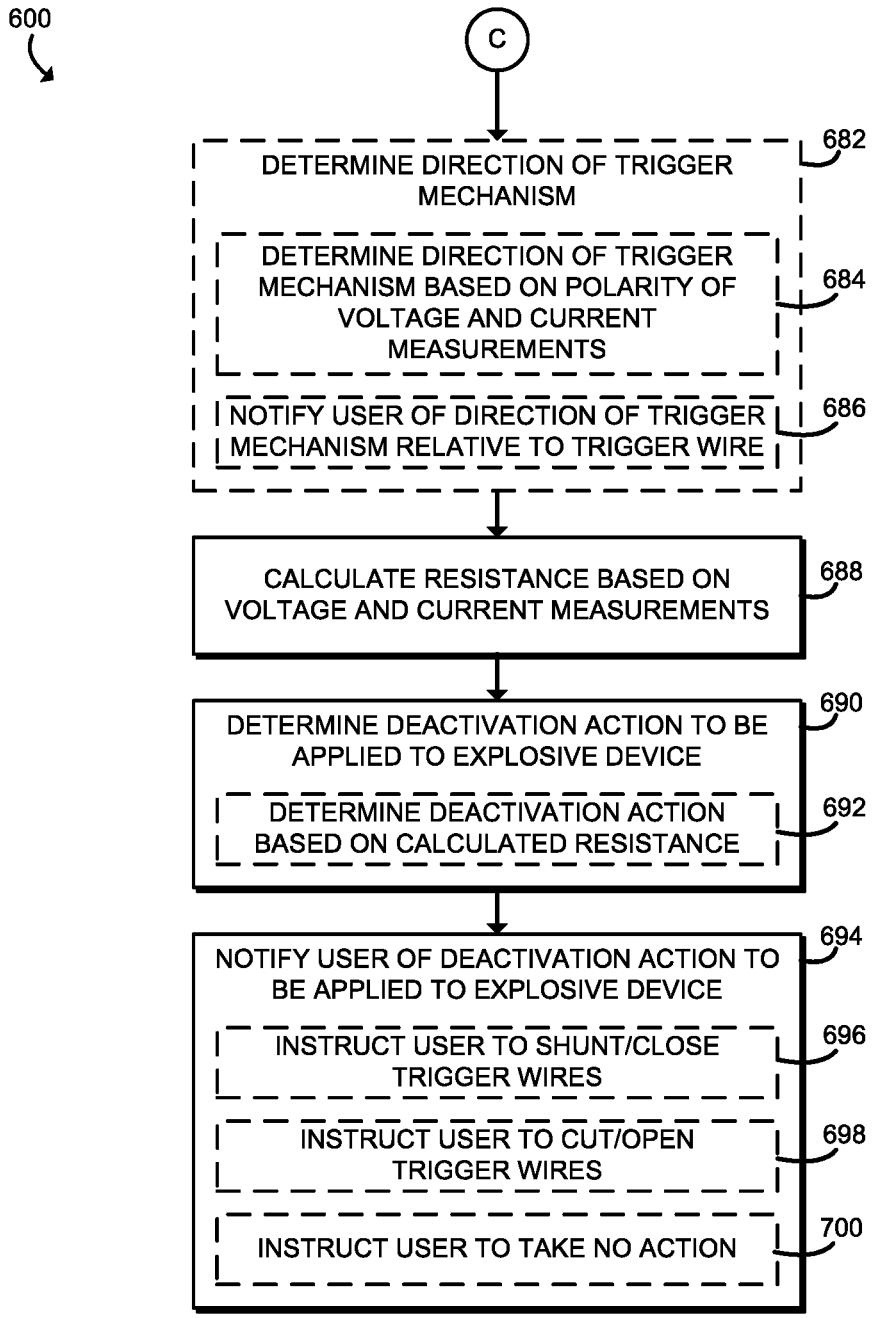

After notifying the user of completion of the second phase of analysis in block 674, the method 600 advances to block 682 of FIG. 9. In block 682, in some embodiments, the analysis device 100 may determine the direction of the trigger mechanism 204 relative to analysis device 100. That is, in some embodiments, the trigger wires 220, 222 may be entangled, hidden, or otherwise obscured such that the location of the trigger mechanism 204 relative to the analysis device 100 is undeterminable by mere visual inspection. As such, the analysis device 100 may be configured to determine the direction of the trigger mechanism 204 relative to the device 100 (e.g., relative to one or more of the leads 102, 106, 108). To do so, in block 684, the analysis device 100 may determine the direction of the trigger mechanism 204 based on the polarity of the measured voltage and direction of the current as determined in blocks 648 and 670, respectively. Additionally, once determined, the analysis device 100 may notify the user of the direction of the trigger mechanism 204 in block 686. For example, the analysis device 100 may display an indication on the display 142 of the direction of the trigger mechanism 204 relative to one of the secondary leads 106, 108 in some embodiments. It should be appreciated that knowledge of the location of the trigger mechanism 204 may be useful, or even required, in performing one or more of the deactivation actions.

In block 688, the analysis device 100 calculates a resistance of the trigger mechanism 204 based on the measured voltage and current as determined in blocks 648 and 670, respectively. To do so, as discussed above, the analysis device 100 may utilize any suitable methodology to determine the resistance. For example, in the illustrative embodiment, the analysis device 100 determines the resistance of the trigger mechanism 204 using Ohm's law and the measured voltage and current (i.e., Resistance=Voltage/Current).

After the resistance of the trigger mechanism 204 has been determined in block 688, the method 600 advances to block 690 in which the analysis device 100 determines or selects a particular deactivation action to be applied to the explosive device 200. To do so, in block 692, the analysis device 100 determines the deactivation action based on the resistance determined in block 688. For example, as discussed above, the analysis device 100 may determine that the trigger wires 220, 222 should be closed or shunted together in response to a determination that the resistance value is less than the low resistance threshold value (e.g., less than 10 ohms). Alternatively, the analysis device 100 may determine that the trigger wires 220, 222 should be opened or cut (i.e. at least one of the trigger wires 220, 222 should be cut or opened) in response to a determination that the resistance value is greater than the high resistance threshold value (e.g., greater than 10 megaohms). Further, the analysis device 100 may determine that no action should be applied to the explosive device 200 in response to a determination that the resistance value is neither less than the low resistance threshold value nor greater than the high resistance value. As discussed above, under such conditions, the analysis device 100 has determined that the trigger mechanism 204 and/or the detonation circuit 210 is of a complex design and the explosive device 200 cannot be properly deactivated, neutralized, or otherwise rendered inactive using the analysis device 100 alone.

After the analysis device 100 has determined the appropriate deactivation action to be applied to the explosive device 200 based on the determined resistance of the trigger mechanism 204, the method 600 advances to block 694 in which the analysis device 100 notifies the user of the determined deactivation action. For example, the analysis device 100 may display an appropriate instruction message on the display 142 and/or illuminating one or more visual indicators 144. In the illustrative embodiment, the analysis device 100 may instruct the user to shunt or close the trigger wires 220, 222 in block 696, to cut or open at least one of the trigger wires 220, 222 in block 698, or to take no action in block 700. As discussed above, the particular deactivation action displayed or otherwise provided to the user in block 694 is based on the resistance of the trigger mechanism 204 determined in block 688. Additionally, although only three deactivation actions have been described herein, it should be appreciated that additional or other deactivation actions may be determined, based on the determined resistance, in other embodiments. Further, it should be appreciated that the method 600 is merely illustrative, and that the analysis device 100 may perform other methods to analyze the explosive device in addition to, or alternatively to, the method 600. For example, in some embodiments, the method 600 may include additional or different method blocks and/or execute the illustrative blocks in a different order.

Figure 10:
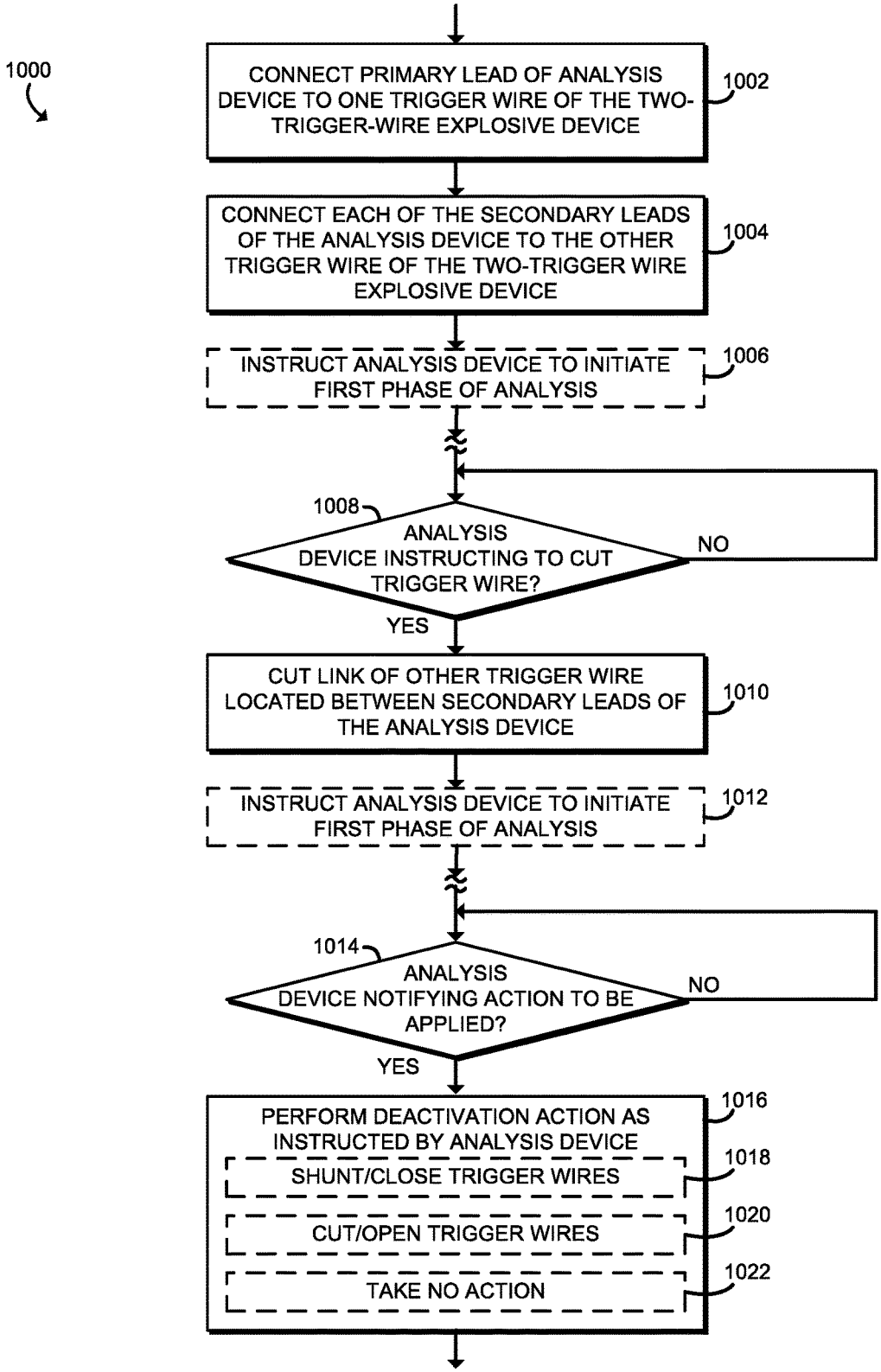
FIG. 10 is a simplified block diagram of at least one embodiment of a method for deactivating an explosive device that may be performed by a user of the analysis device of FIG. 1.

Referring now to FIG. 10, a user may perform a method 1000 to deactivate, neutralize, or otherwise render inactive an explosive device using the analysis device 100. The method 1000 begins with block 1002 in which the user electrically connects the analysis device 100 to the two-trigger-wire explosive device 200. To do so, the user connects the primary lead 102 to one of the trigger wires 220. Additionally, in block 1004, the user connects each of the secondary leads 106, 108 to the other trigger wire 222. As discussed above and shown in FIG. 2, the user connects the secondary leads 106, 108 to the other trigger wire 222 such that a link 224 of trigger wire 222 is defined between the secondary leads 106, 108.

After the analysis device 100 has been electrically connected to the trigger wires 220, 222 of the explosive device 200 as discussed above, the user may instruct the analysis device 100 to perform the first phase of the analysis in block 1006. For example, the user may select an appropriate activation input device 132 (e.g., a hardware or software button) to cause the analysis device to initiate the first phase of the analysis. As discussed above, the analysis device 100 measures a voltage between the primary lead 102 and at least one of the secondary leads 106, 108 during the first phase of the analysis.

Figure 12:
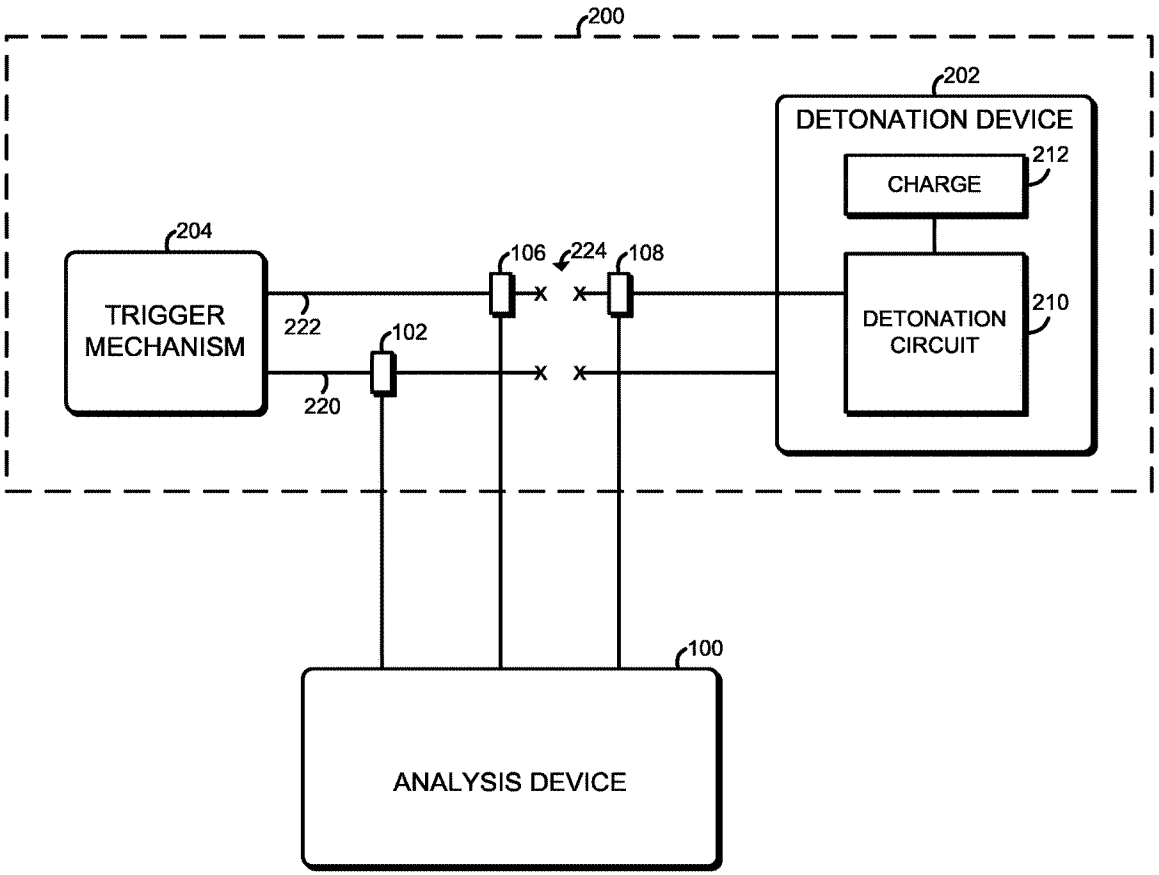
FIG. 12 is a simplified block diagram of at least one embodiment of another deactivation action that may be performed by the user of the analysis device of FIG. 1 based on the analysis performed by the method of FIGS. 6-9.

After the analysis device 100 has initiated the first phase of the analysis, the method 1000 advances to block 1008 in which the user determines whether the analysis device 100 has confirmed that the first phase of analysis has been completed and instructed the user to cut or break the link 224 of the trigger wire 222 located between the secondary leads 106, 108. If not, the method loops back to block 1008 in which the user continues to await for completion of the first phase and the instruction to cut the link 224. If, however, the analysis device 100 has completed the first phase of the analysis and instructed the user to cut the link 224, the method 1000 advances to block 1010 in which the user cuts or breaks the link 224. For example, as shown in FIG. 12, the user may cut or break the link 224 of the trigger wire 222 located between the secondary lead 106 and the secondary lead 108.

Referring back to FIG. 10, after the user has cut or broken the link 224, the user may instruct the analysis device 100 to perform the second phase of the analysis in block 1012. For example, the user may select an appropriate activation input device 132 (e.g., a hardware or software button) to cause the analysis device to initiate the second phase of the analysis. As discussed above, the analysis device 100 measures a current, if any, flowing through the secondary leads 106, 108 during the second phase of the analysis.

After the analysis device 100 has initiated the second phase of the analysis, the method 1000 advances to block 1014 in which the user determines whether the analysis device 100 has confirmed that the second phase of analysis has been completed and instructed the user as to which deactivation action should be applied to the explosive device 200. As discussed in detail above, the analysis device 100 is configured to determine the particular deactivation action to be applied to the explosive device 200 based on a resistance determined using the measured voltage and current.

Figure 11:
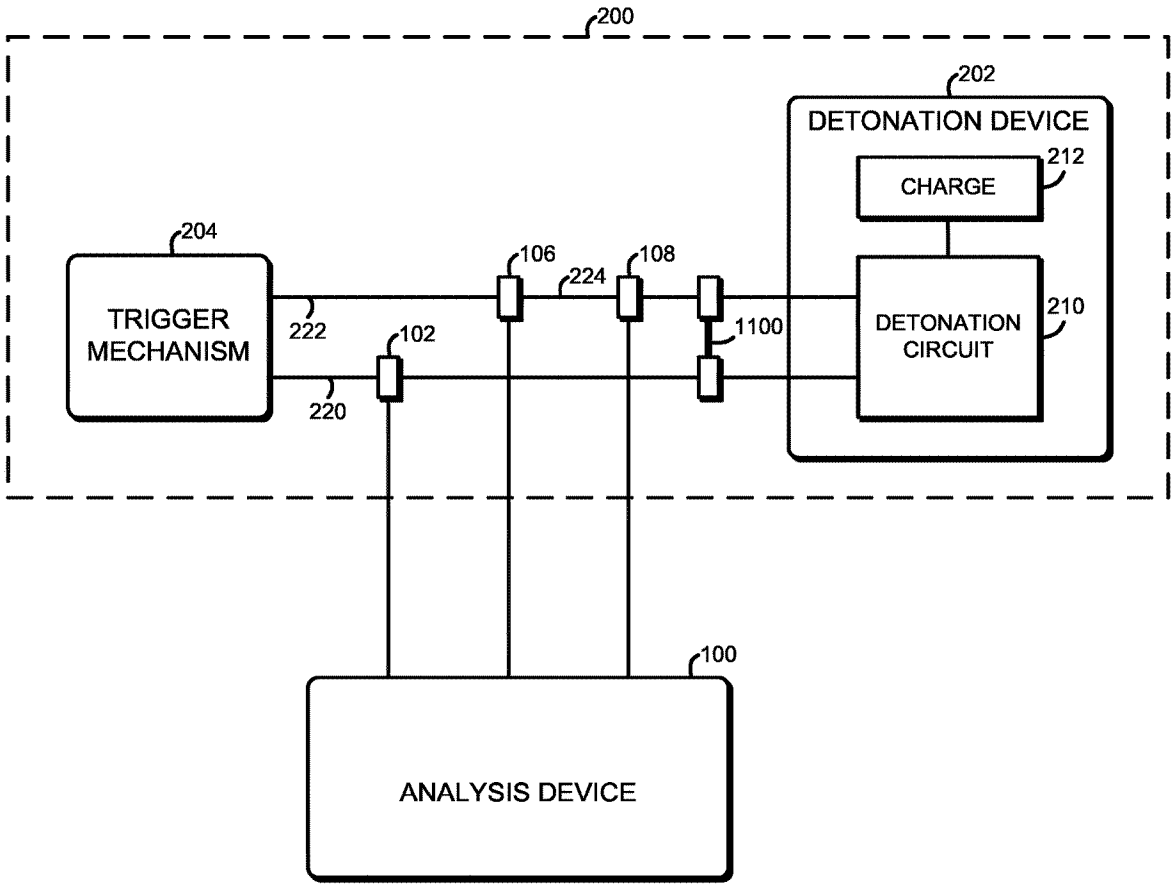
FIG. 11 is a simplified block diagram of at least one embodiment of a deactivation action that may be performed by the user of the analysis device of FIG. 1 based on the analysis performed by the method of FIGS. 6-9.

If the analysis device 100 has determined and notified the user of the deactivation action, the user performs the determined deactivation action on the explosive device 200 in block 1016. For example, as discussed above, the analysis device 100 may determine that the trigger wires 220, 222 should be closed or shunted together in response to a determination that the determined resistance is less than a low resistance threshold value. If so, the user may shunt or close the trigger wires 220, 222 in block 1018. For example, as shown in FIG. 11, the user may electrically connect a shunt 1100 between the trigger wires 220, 222 to short or shunt the trigger wires 220, 222 together. It should be appreciated that the shunt 1100 is applied on the side closest toward the detonation circuit 210, which may be determined based on the location of the trigger mechanism 204 as determined in block 682 of method 600 of FIG. 9. After the trigger wires 220, 222 have been shunted, the user may remote and/or dispose of the detonation device 202 in a relatively safe manner.

Alternatively, as discussed above, the analysis device 100 may determine that the trigger wires 220, 222 should be opened or cut in response to a determination that the determined resistance is greater than a high resistance threshold value. If so, the user may cut or open at least one of the trigger wires 220, 222 in block 1020. For example, as shown in FIG. 12, the user may cut, break, or otherwise open each of the trigger wires 220, 222. After the trigger wires 220, 222 have been opened or cut, the user may remote and/or dispose of the detonation device 202 in a relatively safe manner.

Further, as discussed above, the analysis device 100 may determine that no deactivation action should be applied to the explosive device 200 in response to a determination that the determined resistance is neither lower than the low resistance threshold value nor greater than the high resistance threshold value. In such circumstances, the analysis device 100 has determined that the trigger mechanism 204 and/or the detonation circuit 210 is of a complex design and the explosive device 200 cannot be properly deactivated, neutralized, or otherwise rendered inactive using the analysis device 100 alone. As such, the user may utilize additional devices, mechanisms, and/or methodologies to deactivate the explosive device 200 as discussed above.

The invention claimed is:

1. A method for analyzing an explosive device, the method comprising:

measuring, by an analysis device electrically coupled to the explosive device, a voltage between a primary lead of the analysis device and at least one of a pair of secondary leads of the analysis device, wherein the primary lead is electrically connected to a first trigger wire of the explosive device and each of the secondary leads is electrically coupled to a second trigger wire of the explosive device;

measuring, by the analysis device, a current flowing through the pair of secondary leads electrically coupled to the second trigger wire of the explosive device;

determining, by the analysis device, a resistance of a trigger mechanism of the explosive device based on the measured voltage and current; and determining, by the analysis device, a deactivation action to be applied to the explosive device based on the determined resistance of the trigger mechanism.

2. The method of claim 1, wherein measuring the voltage between the primary lead and the at least one of the pair of secondary leads comprises:

determining, by the analysis device, whether continuity between a first secondary lead and a second secondary lead of the pair of secondary leads has been established; and measuring, by the analysis device, a voltage between the primary lead and the at least one of the first secondary lead and the second secondary lead in response to a determination that continuity between the first secondary lead and the second secondary lead of the pair of secondary leads has been established.

3. The method of claim 2, wherein measuring the current flowing through the pair of secondary leads comprises:

determining, by the analysis device, whether continuity between the first secondary lead and the second secondary lead has been broken; and measuring, by the analysis device, the current flowing through the pair of secondary leads in response to a determination that the continuity between the secondary leads has been broken.

4. The method of claim 3, wherein determining whether continuity between the secondary leads has been broken comprises determining, by the analysis device, whether a link of the second trigger wire extending between the first secondary lead and the second secondary lead has been broken.

5. The method of claim 3, further comprising instructing, by the analysis device, a user of the analysis device to cut the link of the second trigger wire extending between the first secondary lead and the second secondary lead prior to measuring the current flowing through the pair of secondary leads.

6. The method of claim 1, wherein determining the deactivation action comprises determining, by the analysis device, that the first trigger wire and the second trigger should be shunted together.

7. The method of claim 6, wherein determining that the first trigger wire and the second trigger should be shunted together comprises determining that the first trigger wire and the second trigger should be shunted together in response to the determined resistance being less than a low resistance threshold value.

8. The method of claim 1, wherein determining the deactivation action comprises determining, by the analysis device, that at least one of the first trigger wire and the second trigger should be cut.

9. The method of claim 8, wherein determining that at least one of the first trigger wire and the second trigger should be cut comprises determining that at least one of the first trigger wire and the second trigger should be cut in response to the determined resistance being greater than a high resistance threshold value.

10. The method of claim 1, wherein determining the deactivation action comprises determining, by the analysis device, that no action should be applied to the explosive device.

11. The method of claim 10, wherein determining that no action should be applied to the explosive device comprises determining that no action should be applied to the explosive device in response to the determined resistance being between a low resistance threshold value and a high resistance threshold value.

12. The method of claim 1, further comprising displaying, by the analysis device, the measured voltage and the measured current on a display of the analysis device.

13. The method of claim 1, further comprising displaying, by the analysis device, the determined resistance of the trigger mechanism on a display of the analysis device.

14. The method of claim 1, further comprising notifying, by the analysis device, a user of the analysis device of the deactivation action to be applied to the explosive device.

15. The method of claim 1, further comprising:

determining, by the analysis device, a direction of trigger mechanism relative to at least one of the pair of trigger wires; and notifying, by the analysis device, a user of the analysis device of the direction of the trigger mechanism relative to the at least one of the pair of trigger wires.

16. An analysis device for analyzing an explosive device, the analysis device comprising:

a primary lead configured to be electrically coupled to a first trigger wire of the explosive device;

a pair of secondary leads configured to be electrically coupled to a second trigger wire of the explosive device;

an analysis circuit configured to (i) measure a voltage between the primary lead and at least one of the pair of secondary leads and (ii) measure a current established through the pair of secondary leads; and a processor circuit configured to (i) determine a resistance of a trigger mechanism of the explosive device based on the measured voltage and current and (ii) a deactivation action to be applied to the explosive device based on the determined resistance of the trigger mechanism.

17. The analysis device of claim 16, wherein the analysis circuit is further configured to determine whether continuity between a first secondary lead of the pair of secondary leads and a second secondary lead of the pair of secondary leads has been established; and wherein to measure the voltage between the primary lead and the at least one of the pair of secondary leads comprises to measure a voltage between the primary lead and the at least one of the first secondary lead and the second secondary lead in response to a determination that continuity between the first secondary lead and the second secondary lead of the pair of secondary leads has been established.

18. The analysis device of claim 17, wherein the analysis circuit is further configured to determine whether continuity between the first secondary lead and the second secondary lead has been broken; and wherein to measure the current established through the pair of secondary leads comprises to measure a current established through the pair of secondary leads in response to a determination that the continuity between the secondary leads has been broken.

19. The analysis device of claim 18, wherein to determine whether continuity between the secondary leads has been broken comprises to determine a whether a link of the second trigger wire extending between the first secondary lead and the second secondary lead has been broken.

20. The analysis device of claim 18, further comprising an output device, and wherein the processor circuit is further to provide an instruction, via the output device, to a user of the analysis device to cut the link of the second trigger wire extending between the first secondary lead and the second secondary lead prior to the analysis circuit performing the measurement of the current established through the pair of secondary leads.

21. The analysis device of claim 16, wherein to determine the deactivation action comprises to determine that the first trigger wire and the second trigger should be shunted together.

22. The analysis device of claim 21, wherein to determine that the first trigger wire and the second trigger wire should be shunted together comprises to determine that the first trigger wire and the second trigger wire should be shunted together in response to the determined resistance being less than a low resistance threshold value.

23. The analysis device of claim 16, wherein to determine the deactivation action comprises to determine that at least one of the first trigger wire and the second trigger should be cut.

24. The analysis device of claim 23, wherein to determine that at least one of the first trigger wire and the second trigger should be cut comprises to determine that at least one of the first trigger wire and the second trigger should be cut in response to the determined resistance being greater than a high resistance threshold value.

25. The analysis device of claim 16, wherein to determine the deactivation action comprises to determine that no action should be applied to the explosive device.

26. The analysis device of claim 25, wherein to determine that no action should be applied to the explosive device comprises to determine that no action should be applied to the explosive device in response to the determined resistance being between a low resistance threshold value and a high resistance threshold value.

27. The analysis device of claim 16, further comprising a display, and wherein the processor circuit is further configured to display the measured voltage and the measured current on the display.

28. The analysis device of claim 16, further comprising a display, and wherein the processor circuit is further configured to display the determined resistance of the trigger mechanism on the display.

29. The analysis device of claim 16, further comprising at least one output device, and wherein the processor circuit is further configured to provide a notification, via the at least one output device, to a user of the analysis device of the deactivation action to be applied to the explosive device.

30. The analysis device of claim 16, wherein the processor circuit is further configured to:

determine a direction of trigger mechanism relative to at least one of the pair of trigger wires; and notify, via at least one output device of the analysis device, a user of the analysis device of the direction of the trigger mechanism relative to the at least one of the pair of trigger wires.

31. A method for deactivating an explosive device, the method comprising:

connecting a primary lead of an analysis device to a first trigger wire of the explosive device;

connecting each of a pair of secondary leads of the analysis device to a second trigger wire of the explosive device;

controlling the analysis device to perform a measurement of a voltage between the primary lead and at least one of a pair of secondary leads;

cutting a link of the second trigger wire between the pair of secondary leads;

controlling the analysis device to perform a measurement of a current flowing through the pair of secondary leads after cutting the link of the second trigger wire; and performing a deactivation action on the explosive device based on an instruction provided by the analysis device based on the measured voltage and current.

32. The method of claim 31, wherein performing the deactivation action comprises (i) electrically shunting the first trigger wire and the second trigger wire or (ii) cutting one of the first trigger wire or second trigger wire.

* * * * *